US010017898B2

(12) United States Patent
Husmann et al.

(10) Patent No.: US 10,017,898 B2
(45) Date of Patent: Jul. 10, 2018

(54) USE OF A SURFACTANT COMPOSITION FOR THE HYDROPHILIC FINISHING OF TEXTILE FIBERS AND TEXTILE PRODUCTS MANUFACTURED THEREFROM

(71) Applicant: Schill + Seilacher GmbH, Böblingen (DE)

(72) Inventors: Sandra Husmann, Leinfelden-Echterdingen (DE); Michaela Munzar, Sindelfingen (DE); Wolfgang Warncke, Tuebingen (DE)

(73) Assignee: SCHILL+ SEILACHER GMBH, Böblingen (DE)

( * ) Notice: Subject to any disclaimer, the term of this patent is extended or adjusted under 35 U.S.C. 154(b) by 178 days.

(21) Appl. No.: 15/035,377

(22) PCT Filed: Dec. 3, 2014

(86) PCT No.: PCT/EP2014/076392
§ 371 (c)(1),
(2) Date: May 9, 2016

(87) PCT Pub. No.: WO2015/082534
PCT Pub. Date: Jun. 11, 2015

(65) Prior Publication Data

US 2016/0281293 A1 Sep. 29, 2016

(30) Foreign Application Priority Data

Dec. 6, 2013 (DE) ..... 10 2013 113 656

(51) Int. Cl.

| | |
|---|---|
| ***D06M 13/224*** | (2006.01) |
| ***D06M 15/53*** | (2006.01) |
| *D06M 101/20* | (2006.01) |
| *D06M 101/32* | (2006.01) |

(52) U.S. Cl.
CPC ..... *D06M 13/2243* (2013.01); *D06M 13/224* (2013.01); *D06M 13/2246* (2013.01); *D06M 15/53* (2013.01); *D06M 2101/20* (2013.01); *D06M 2101/32* (2013.01)

(58) Field of Classification Search
CPC ..... D06M 13/2243; D06M 13/2246; D06M 2101/20
See application file for complete search history.

(56) References Cited

U.S. PATENT DOCUMENTS

| | | | | |
|---|---|---|---|---|
| 5,033,172 A * | 7/1991 | Harrington | D01F 1/10 | 156/244.17 |
| 5,976,995 A * | 11/1999 | Palmer, Jr. | C09D 167/025 | 442/118 |
| 6,214,463 B1 * | 4/2001 | Nishijima | B01D 39/083 | 428/373 |
| 6,506,394 B1 * | 1/2003 | Yahiaoui | A61K 8/0208 | 424/400 |

FOREIGN PATENT DOCUMENTS

| | | |
|---|---|---|
| DE | 4441029 A1 | 5/1996 |
| DE | 10034232 A1 | 1/2001 |
| DE | 69716636 T2 | 6/2003 |
| DE | 10084749 B4 | 2/2013 |
| EP | 0839947 A2 | 5/1998 |
| JP | 2007107131 A | 4/2007 |

OTHER PUBLICATIONS

Complete Textile Glossary, Celanese Acetate, entries for "air-laid nonwovens" and "wet-laid nonwovens," 2001. (Year: 2001).*
German Search Report dated Jul. 24, 2014 in connection with the German priority application DE102013113656.7, along with English translation of the Examiner's opinion in the Search Report.
PCT International Search Report and Written Opinion dated Mar. 13, 2015, from corresponding Application No. PCT/EP2014/076392, along with unofficial English translation of ISR, 6 pages.

* cited by examiner

*Primary Examiner* — Jeremy R Pierce
(74) *Attorney, Agent, or Firm* — Dilworth IP, LLC

(57) ABSTRACT

A surfactant composition for use for applying a permanent hydrophilic finish to textile fibers and textile products manufactured therefrom contains 40 to 90% by weight of a mixture of at least one non-ionic surfactant and optionally at least one anionic surfactant and/or one cationic surfactant, and up to 60% by weight of a hydrophobic additive. The hydrophobic additive comprises at least one compound of the group of fatty acid esters, vegetable oils and fats, and mixtures thereof.

19 Claims, No Drawings

USE OF A SURFACTANT COMPOSITION FOR THE HYDROPHILIC FINISHING OF TEXTILE FIBERS AND TEXTILE PRODUCTS MANUFACTURED THEREFROM

TECHNICAL FIELD OF THE INVENTION

The present invention relates to surfactant compositions for applying a hydrophilic finish to textile fibers and textile products manufactured therefrom such as nonwovens, which confer permanently hydrophilic properties to these basically hydrophobic substrates.

BACKGROUND OF THE INVENTION

Hydrophilic nonwoven fabrics are used in particular as nonwoven covering fabrics or as nonwoven intermediate fabrics in multi-layer nonwoven fabrics for sanitary products such as baby diapers, sanitary napkins, incontinence products and similar products. Such nonwoven fabrics function to quickly pass body fluids such as urine to the underlying absorption layer.

For producing the nonwoven covering fabrics, fibers or filaments of polyolefin or polyester are used in most cases. These polymers, however, are hydrophobic and therefore have to be hydrophilized either during production of the fiber and/or during the further processing into the nonwoven fabric. Hydrophilizing is usually performed by treating the filaments with known spinning preparations which are then processed further to form staple fibers and nonwoven fabrics. Also common is the treatment of the nonwoven fabrics with a hydrophilic finishing agent as a so-called "top coat" prior to the further processing into a sanitary product.

The treatment of the hydrophobic fibers, filaments or nonwoven fabrics with a hydrophilic spinning preparation or a hydrophilic finishing or dressing agent is intended to result in as long-lasting a hydrophilizing as possible, which is not or only to a minor degree washed out by fluids, and to provide the nonwoven fabric with as constant a hydrophilicity as possible over as long a period of its useful life as possible.

Such hydrophilizing compositions are known in the prior art. U.S. Pat. No. 4,988,449 describes hydrophilizing compositions which contain diethanol amides and non-ionic surfactants, alkyl phosphates, quaternary ammonium salts and/or alkyl imidazolium salts and are made use of as agents providing fluid permeability to polyolefin nonwovens.

U.S. Pat. No. 5,258,129 discloses hydrophilizing compositions which contain polyoxyalkylene-modified polydimethylsiloxanes alone or in combination with non-ionic surfactants, alkyl phosphates, quaternary ammonium salts and/or alkyl imidazolium salts.

EP 410 485 B1 discloses a method of hydrophilizing polyolefin fiber nonwovens by applying an aqueous mixture of alkoxylated surfactants to the surface of the fibers, wherein at least 80% of the composition consists of alkoxylated triglycerides of $C_{18}$ fatty acids.

EP 0 839 947 A2 discloses hydrophilizing compositions that contain non-ionic surfactants in combination with a polyoxyalkylene-modified polydimethylsiloxane and/or a quaternary ammonium compound.

EP 1 600 532 B1 describes hydrophilizing compositions that consist of an alkoxylated glycerol esterified with a fatty acid and an alkoxylated or alkoxylated and hydrogenated ricinolein esterified with a fatty acid.

To increase the wearing comfort of incontinence products, it has already been proposed that the hydrophilic nonwoven covering fabrics arranged on the side facing the body be subsequently finished with hydrophobic care lotions on the diaper making machine. EP 1 671 609 B1 proposes applying the lotion in the form of a pattern of a plurality of stripes onto the surface, facing the body, of the nonwoven covering fabric, so that the nonwoven covering fabric can continue to fulfill its function of distribution of liquid.

WO 2012/047986 A2 describes a lotion for being applied to the nonwoven covering fabric of a sanitary product, the lotion being adjusted to be hydrophilic and comprising 0.1-90% of a microcrystalline wax, 0.1 to 25% by weight of a POE-4 monolaurate, 0.1 to 50% by weight of a POE-8 monostearate, and a carrier such as petrolatum.

SUMMARY OF THE INVENTION

Compared with the above-mentioned prior art, the object consists in providing a composition for a simple and cost-effective finishing of textile fibers and textile products with permanently hydrophilic properties, which can more particularly be further processed into sanitary products with an increased wearing comfort.

This object is achieved by the use of a surfactant composition for applying a hydrophilic finish to textile fibers and textile products, having the features of claim 1.

Further advantageous embodiments are indicated in the dependent claims, which optionally may be combined with each other.

According to the invention, use is made of a surfactant composition for applying a permanent hydrophilic finish to textile fibers and textile products manufactured therefrom, the composition containing at least one non-ionic surfactant and optionally at least one anionic and/or one cationic surfactant, characterized in that the composition further contains a hydrophobic additive in a proportion of up to 60% by weight, based on the total weight of the composition without solvent(s), the hydrophobic additive comprising at least one compound of the group of fatty acid esters, vegetable oils and fats, and mixtures thereof.

The non-ionic surfactant is selected from the group of alkoxylated $C_6$ to $C_{18}$ fatty alcohols, alkoxylated $C_6$ to $C_{18}$ amines, alkoxylated $C_6$ to $C_{18}$ amides, alkoxylated $C_6$ to $C_{18}$ fatty acids, alkoxylated $C_6$ to $C_{18}$ fatty acid esters and alkoxylated $C_8$ to $C_{18}$ alkyl phenols as well as alkoxylated triglycerides of $C_6$ to $C_{18}$ fatty acids and/or esterification products thereof with $C_8$ to $C_{18}$ fatty acids.

Within the meaning of the invention, "permanently hydrophilic" should be understood to mean a product (fiber or web) treated with a finishing agent which passes the "multi strike through" test in accordance with WSP standard 70.7 (11) with strike through times of <2/<3/<5/<5/<5 seconds.

The surfactant composition used according to the invention confers to the textile products finished therewith an excellent pass-through capability for body fluids. At the same time, the composition provides a good wearing comfort to the absorbent articles manufactured from these textile products.

In an aqueous dilution, the compositions according to the invention may be used particularly well as fiber preparations for applying a permanent hydrophilic finish to textile fibers. The surfactant composition is then preferably present in the form of an emulsion or paste. In addition, the compositions are suitable for use as a dressing agent or "top coat" for applying a hydrophilic finish to the textile products manufactured from such fibers and filaments. In this way, the method of manufacturing the textile products, in particular sanitary products and incontinence products, can be significantly simplified since the subsequent application of care lotions onto the nonwoven covering fabrics in a diaper making machine may be dispensed with.

Within the meaning of the invention, the term "fibers" also comprises "filaments" including monofilaments and multifilaments. The terms "fibers" and "filaments" are therefore used synonymously.

Fibers, materials or surfaces are referred to as being "hydrophobic" if they are not spontaneously wettable with water or have a contact angle of greater than 90 degrees. Hydrophilic fibers, materials and surfaces are spontaneously wettable with water and aqueous liquids or exhibit a contact angle of less than 90 degrees.

Unless otherwise indicated, details given in % by weight relate to the total proportion of the active components of the surfactant composition, in particular surfactants, hydrophobic additives and, optionally, care additives. Depending on the purpose of use, the composition may also contain water and other solvents, which are not included in the calculation of the proportions.

DETAILED DESCRIPTION OF PREFERRED EMBODIMENTS

The textile fibers employed are in particular synthetic fibers or filaments made from polyolefins and polyester such as polyethylene terephthalate (PET). The textile products manufactured from these fibers preferably are nonwoven textile products (nonwovens), in particular nonwoven fabrics.

The surfactant mixture used for permanently hydrophilizing the textile fibers and textile products comprises at least one non-ionic surfactant and optionally at least one anionic surfactant and/or one cationic surfactant. The combination of different surfactants allows to achieve a good wettability of the fibers.

The total proportion of the surfactants in the composition according to the invention preferably amounts to 40 to 95% by weight, particularly preferably 50 to 90% by weight and particularly preferably 50 to 80% by weight.

The hydrophobic additive is preferably contained in the composition in a proportion of from 5 to 60% by weight. Particularly preferably, the proportion of the hydrophobic additive amounts to 10 to 50% by weight, in particular 20 to 50% by weight.

Particularly preferably, the hydrophobic additive is liquid at room temperature (20° C.).

The non-ionic surfactant is preferably present in the composition in a proportion of from 10 to 90% by weight. Preferably, the proportion of the non-ionic surfactant amounts to 15 to 80% by weight and particularly preferably 30 to 80% by weight.

The anionic surfactant may be present in the composition in a proportion of from about 1 to 60% by weight. Preferably, the proportion of the anionic surfactant amounts to about 1 to 55% by weight, particularly preferably 1 to 30% by weight.

The cationic surfactant may be present in the composition in a proportion of from about 1 to 60% by weight. Preferably, the proportion of the cationic surfactant amounts to about 5 to 60% by weight and particularly preferably about 10 to 55% by weight.

Preferably, the non-ionic surfactant and the anionic surfactant may be present in the composition according to the invention in a weight ratio of from 35:65 to 98:2, preferably from 70:30 to 98:2.

Preferably, the non-ionic surfactant and the cationic surfactant may be present in the composition according to the invention in a weight ratio of from 35:65 to 98:2, preferably to 80:20.

The composition may also contain both at least one anionic surfactant and at least one cationic surfactant, together with at least one non-ionic surfactant.

In addition, the composition according to the invention may optionally contain further additives selected from the group of antistatic agents, wetting agents, cohesion agents, lubricants, anti-corrosion agents and emulsifiers. Typically, these additives may also constitute non-ionic, cationic or anionic surfactants within the meaning of the invention. These additives are known in the prior art and commercially available in the field of spinning preparations and dressing agents.

The non-ionic surfactant is selected from the group of alkoxylated $C_6$ to $C_{18}$ fatty alcohols, alkoxylated $C_6$ to $C_{18}$ amines, alkoxylated $C_6$ to $C_{18}$ amides, alkoxylated $C_6$ to $C_{18}$ fatty acids, alkoxylated $C_6$ to $C_{18}$ fatty acid esters and alkoxylated $C_8$ to $C_{18}$ alkyl phenols as well as alkoxylated triglycerides of $C_6$ to $C_{18}$ fatty acids and/or esterification products thereof with $C_8$ to $C_{18}$ fatty acids.

The hydrocarbon chains of these compounds may each be branched or straight-chain, saturated or unsaturated.

Preferably, the non-ionic surfactant is an alkoxylated fatty alcohol with 6 to 18 C atoms in the hydrocarbon chain, an alkoxylated fatty acid with 6 to 18 C atoms in the hydrocarbon chain, an alkoxylated triglyceride of $C_6$ to $C_{18}$ fatty acids, and mixtures thereof.

Especially preferred are fatty alcohol alkoxylates and fatty acid alkoxylates with 8 to 18 C atoms in the hydrocarbon chain.

The fatty alcohol alkoxylates and fatty acid alkoxylates may have a hydroxyl or an alkyl or alkenyl ether group as a terminal group. Particularly preferred are hydroxyl group-terminated fatty alcohol and fatty acid alkoxylates.

The number of alkoxy groups in the non-ionic surfactant is preferably from 1 to 10, more preferably from 2 to 8 and particularly preferably from 2 to 6.

The alkoxy groups may in particular be derived from ethylene glycol or propylene glycol.

Particularly preferred are fatty alcohol ethoxylates and fatty acid ethoxylates with 8 to 18 C atoms in the hydrocarbon chain and 2 to 6 ethylene glycol units, ethoxylated triglycerides of $C_6$ to $C_{18}$ fatty acids with 2 to 6 ethylene glycol units per fatty acid chain, and mixtures thereof.

The anionic surfactant may preferably be a surfactant selected from the group of $C_6$ to $C_{18}$ alkyl sulfates, alkyl ether sulfates, alkyl sulfonates, $C_6$ to $C_{18}$ alkyl sarcosinates, $C_6$ to $C_{18}$ dialkyl sulfosuccinates or neutralized alkyl phosphoric acid esters and mixtures thereof.

$C_6$ to $C_{18}$ dialkyl sulfosuccinates and neutralized alkyl phosphoric acid esters and mixtures thereof are preferred.

The neutralized alkyl phosphoric acid ester preferably corresponds to the following general formula (I):

$$P(=O)(OR^1)(OR^2)(OR^3) \quad (I)$$

where $R^1$, $R^2$ and independently of each other, denote $R^3$ (i) an alkoxylated alkyl group with 4 to 22 C atoms in the hydrocarbon chain or an alkoxylated alkenyl group with 4 to 22 C atoms in the hydrocarbon chain, wherein the alkoxy groups are derived from ethylene glycol or propylene glycol and the number of alkoxy groups per alkyl or alkylene group is between 1 and 10, and wherein the alkyl groups or alkenyl groups may each be branched or straight-chain, saturated or unsaturated;

(ii) an alkyl group with 4 to 22 C atoms or an alkenyl group with 4 to 22 C atoms which may each be branched or straight-chain, saturated or unsaturated; and/or (iii) hydrogen, wherein at least one of the radicals $R^1$, $R^2$ and $R^3$ is not hydrogen.

As a neutralizing agent for the phosphoric acid ester, all suitable bases such as, for example, LiOH, NaOH, KOH, $NH_3$, mono-, di- or triethanolamine can be used.

At least one of the radicals $R^1$, $R^2$ and $R^3$ in formula (I) of the neutralized phosphoric acid ester is preferably an alkoxylated alkyl or alkenyl group with 6 to 18 C atoms in the hydrocarbon chain and 1 to 6 alkoxy groups, in particular ethoxy groups and/or propoxy groups, particularly preferably an alkoxylated alkyl or alkenyl group with 10 to 18 C atoms in the hydrocarbon chain and 1 to 4 ethoxy groups.

According to a further preferred embodiment, at least one of the radicals $R^1$, $R^2$ and $R^3$ in formula (I) is an alkyl group or an alkenyl group with 6 to 18 C atoms, particularly preferably with 10 to 18 C atoms.

The cationic surfactant which is optionally employed as a further component of the surfactant composition may more particularly be a quaternary ammonium compound that corresponds to the following formula (II):

$$[R^4—C(=O)—X—(CH_2)_n—NR^5R^6—(CH_2)_m—X—C(=O)—R^4]^+Y^- \quad (II)$$

where $R^4$ denotes an alkyl group with 1 to 22 C atoms or an alkenyl group with 2 to 22 C atoms, $R^5$ and $R^6$ independently of each other, denote an alkyl group with 1 to 22 C atoms, hydroxyethyl or a polyglycol radical, X denotes an oxygen atom, NH, N—$CH_3$ or an $(OC_2H_4)_z$ group with z=1 to 10, $Y^-$ denotes one of the anions $CH_3OSO_3^-$, $C_2H_5OSO_3^-$, $CH_3COO^-$, $Cl^-$, phosphate, lactate, citrate, and m and n independently of each other, denote an integer of from 1 to 6.

The radicals $R^4$ to $R^6$ in formula (II) preferably denote alkyl groups as are derived from vegetable oils and oil blends. Particularly preferably, the radicals $R^4$, $R^5$ and $R^6$ are derived from vegetable oils with a high proportion of saturated fatty acids, in particular from palm oil or palm kernel oil.

The hydrophobic additive of the composition according to the invention preferably comprises at least one carboxylic acid alkyl ester, preferably $C_{2-18}$ alkyl ester of carboxylic acids with 4 to 24 C atoms. Particularly preferred are alkyl esters of maleic acid or lactic acid as well as the alkyl esters of the following vegetable fatty acids:palmitic acid, stearic acid, oleic acid, coconut fatty acid, cottonseed oil fatty acid, soybean oil fatty acid, peanut oil fatty acid, sunflower oil fatty acid, linoleic acid, capric acid, lauric acid, myristic acid, behenic acid, erucic acid, and malic acid. The alkyl group preferably is an ethyl, propyl, isopropyl or butyl group or a fatty alcohol group with 8 to 22 C atoms.

As a vegetable oil or fat, in particular coconut oil, almond oil, walnut oil, peach kernel oil, apricot kernel oil, avocado oil, tea tree oil, soybean oil, sesame oil, sunflower oil, tsubaki oil, evening primrose oil, rice bran oil, palm kernel oil, mango seed oil, cuckoo flower oil, thistle oil, macadamia nut oil, grape seed oil, amaranth seed oil, argan oil, bamboo oil, olive oil, wheat germ oil, pumpkin seed oil, mallow oil, hazelnut oil, safflower oil, canola oil, sasanqua oil, jojoba oil, rambutan oil, cocoa butter, shea butter, rose oil, cottonseed oil and/or blends of these oils or fats may be used.

The composition according to the invention may furthermore contain care additives such as vitamins, in particular vitamin E, provitamins and vitamin precursors such as panthenol, aloe vera, plant extracts such as chamomile extract, and humectants such as urea or glycerol.

The proportion of the care additives in the composition according to the invention is preferably at least about 0.5% by weight, and preferably up to 5% by weight, more preferred up to 2% by weight and most preferred up to 1% by weight.

A preferred embodiment of the surfactant composition used in accordance with the invention consists of a mixture of a non-ionic surfactant with an anionic surfactant as well as the hydrophobic additive and, optionally, a care additive, each in the proportions as specified above and having the above-mentioned features.

According to a further embodiment, the composition used in accordance with the invention consists of (a) 35 to 80% by weight of a non-ionic surfactant, selected from the group of alkoxylated fatty acids and fatty alcohols with 6 to 18 C atoms in the hydrocarbon chain, alkoxylated triglycerides of $C_6$ to $C_{18}$ fatty acids, and mixtures thereof;

(b) 1 to 25% by weight of an anionic surfactant, preferably selected from the group of $C_6$ to $C_{18}$ dialkyl sulfosuccinates, neutralized alkyl phosphoric acid esters and mixtures thereof, the weight ratio of the non-ionic surfactant to the anionic surfactant being from 70:30 to 98:2;

(c) 20 to 50% by weight of the hydrophobic additive, selected from the group of $C_8$ to $C_{24}$ fatty acid alkyl esters, vegetable oils and fats, and mixtures thereof; and (d) 0 to 5% by weight of a care additive selected from the group of vitamins, in particular vitamin E, provitamins and vitamin precursors such as panthenol, humectants such as urea and glycerol, aloe vera and plant extracts such as chamomile extract.

An alternative embodiment of the surfactant composition used in accordance with the invention consists of a mixture of a non-ionic surfactant with a cationic surfactant as well as the hydrophobic additive and, optionally, a care additive, each in the proportions as specified above and having the above-mentioned features.

According to a preferred embodiment, the composition used in accordance with the invention consists of (a) 15 to 65% by weight of a non-ionic surfactant, selected from the group of alkoxylated fatty alcohols with 6 to 18 C atoms in the hydrocarbon chain, alkoxylated triglycerides of $C_6$ to $C_{18}$ fatty acids, and mixtures thereof;

(b) 10 to 55% by weight of a cationic surfactant, in particular a quaternary ammonium compound, the weight ratio of the non-ionic surfactant to the cationic surfactant being from 35:65 to 80:20;

(c) 20 to 50% by weight of the hydrophobic additive, selected from the group of $C_8$ to $C_{24}$ fatty acid alkyl esters, vegetable oils and fats, and mixtures thereof; and (d) 0 to 5% by weight of a care additive selected from the group of vitamins, in particular vitamin E, provitamins and vitamin precursors such as panthenol, aloe vera, plant extracts such as chamomile extract, and lipids.

Preferably, the composition according to the invention is present in the form of an aqueous dispersion, an oil or a paste the drying residue of which at 105° C. amounts to between 5 and 100% by weight.

The composition according to the invention is preferably used as a permanently hydrophilizing fiber preparation for polyolefin fibers or polyolefin filaments, or else as an agent for a permanently hydrophilic finishing of nonwoven textile webs (nonwovens) manufactured from polyolefin fibers or polyolefin filaments.

The polyolefin employed may preferably be ethylene- or propylene-based homo- or copolymers.

Examples of such polyolefins are polyethylenes such as HDPE (high density polyethylene), LDPE (low density polyethylene), VLDPE (very low density polyethylene), LLDPE (linear low density polyethylene), MDPE (medium density polyethylene), UHMPE (ultra high molecular polyethylene), VPE (cross-linked polyethylene), HPPE (high pressure polyethylene); polypropylenes such as isotactic polypropylene, syndiotactic polypropylene, metallocene-catalyzed polypropylene, impact strength-modified polypropylene; ethylene- and propylene-based random copolymers, ethylene- and propylene-based block copolymers; EPM (poly[ethylene-co-propylene]); EPDM (poly[ethylene-co-propylene-co-conjugated diene]).

Further suitable polyolefins include, for example, polystyrene; poly(methylstyrene); poly(oxymethylene); metallocene-catalyzed alpha-olefin or cycloolefin copolymers such as norbornene-ethylene copolymers; copolymers containing at least 60% ethylene and/or styrene and less than 40% monomers such as vinyl acetate, acrylic acid ester, methacrylic acid ester, acrylic acid, acrylonitrile or vinyl chloride. Examples of such polymers are poly(ethylene-co-ethyl acrylate), poly(ethylene-co-vinyl acetate), poly(ethylene-co-vinyl chloride) and poly(styrene-co-acrylonitrile).

Further suitable are graft copolymers as well as polymer blends, i.e. mixtures of polymers which contain, inter alia, the above-mentioned polymers, for example polyethylene- and polypropylene-based polymer blends.

Moreover, the composition used in accordance with the invention is suitable for applying a permanent hydrophilic finish to polyester fibers, in particular to fibers made from polyethylene terephthalate, and to nonwovens manufactured therefrom.

The composition according to the invention can be applied to the fibers, filaments or nonwovens in undiluted form or in the form of an aqueous emulsion, more specifically preferably in an amount of from 0.1 to 2%, based on the dry weight of the respective product (fiber, filament, nonwoven fabric).

A method of manufacturing permanently hydrophilized textile products, in particular nonwovens, comprises applying the surfactant composition to a nonwoven, for example a nonwoven fabric, made from polyolefin or polyester, in a diluted or undiluted form, by means of metering pins, kiss rollers, dipping baths or by spraying on. The viscosity desired for the particular form of application can be adjusted by diluting the composition with water or other known solvents. The application weight (OPU) is preferably between 0.1 and 5% by weight, based on the dry weight of the nonwoven.

A method of manufacturing permanently hydrophilically finished textile fibers comprises spinning out a hydrophobic polymer, in particular a polyolefin or polyester, in a melt-spinning device to form a polymer filament, and applying the surfactant composition either in undiluted form or from an aqueous formulation of the composition according to the invention onto the polymer filament in an amount of 0.1 to 5% by weight, based on the dry weight of the polymer filament.

Therefore, textile fibers and filaments and textile products manufactured therefrom, in particular nonwovens, that can be obtained by the above-mentioned methods and are permanently hydrophilically finished or treated with the surfactant composition are also a subject matter of the invention.

Further comprised by the invention is a double finish and treatment of the textile fibers and nonwovens made from polyolefin or polyester, in which first the fibers or filaments are permanently hydrophilically finished, and the nonwoven or nonwoven fabric manufactured therefrom is then permanently hydrophilically finished in accordance with the invention once again as a whole with a surfactant composition.

Particularly preferably, the nonwoven fabrics finished in accordance with the invention are non-compressed random laid nonwovens or chemically or physically compacted, for example needled or heat-set, nonwoven fabrics. The nonwoven fabrics preferably are spunbonded nonwoven fabrics produced from continuous filaments.

According to a preferred embodiment, the nonwoven fabric finished with the composition according to the invention forms a part of an absorbent article. A device that is to be positioned on the skin of a wearer for absorbing and retaining the various excretions from the body is referred to as an absorbent article. Examples of absorbent articles include incontinence articles such as diapers, pant-like diapers, training pants, diaper holders and incontinence panties, as well as feminine sanitary products such as tampons, sanitary napkins and panty liners.

The absorbent article usually comprises a basic unit having a fluid permeable upper layer and a lower layer and an absorbent core that is located between the upper and lower layers and serves to absorb body fluids. The fluid permeable upper layer is oriented toward a wearer when the article is being worn. The lower layer on the opposite side is arranged on the side facing the clothing of the wearer. At least the upper layer is formed from a nonwoven fabric finished according to the invention with the surfactant composition.

The invention will now be explained below with reference to several preferred exemplary embodiments, which, however, are not to be understood in a limiting sense.

Example 1

A surfactant mixture of non-ionic surfactants and an anionic surfactant was produced in a weight ratio of about 90:10 to serve as a finishing agent for permanent hydrophilizing. The non-ionic surfactants used were ethoxylated triglycerides and fatty acid ethoxylates.

Isoproyl palmitate was employed as the hydrophobic additive.

To manufacture a spinning preparation according to the invention, the surfactant mixture and the hydrophobic additive were thoroughly mixed and homogenized in a weight ratio of 50:50.

Examination of the Hydrophilizing Properties

The preparation described above was adjusted to an emulsion containing 5% by weight of active components (surfactants and hydrophobic additive) by dilution with distilled or demineralized water. The emulsion was used as a preparation for permanently hydrophilically finishing a polypropylene (PP) spunbond nonwoven fabric with a weight per unit area of 15 g/m$^2$. The applied weight of active substance (OPU, or oil pick up) amounted to about 1.75%, based on the dry weight of the PP nonwoven fabric.

For testing the compositions in connection with the above-mentioned textile substrate, the analyses described below were carried out.

Multiple Strike Through Time

In accordance with the standard test WSP 70.7 (11), the time required for 5 ml of a synthetic urine solution to penetrate a prepared nonwoven fabric and enter the underlying absorption layer made of filter paper is measured. In order to check whether the hydrophilizing finish is washed out or is indeed permanently hydrophilizing, five successive measurements are taken with the same nonwoven fabric, the absorbent filter paper being replaced each time. The five measured values are given in seconds.

Single Strike Through Time

In accordance with the standard test WSP 70.3 (08) A, the time required for 5 ml of a synthetic urine solution to penetrate a prepared nonwoven fabric and enter the underlying absorption layer made of filter paper is measured. The measured value is given in seconds.

Wetback

In accordance with the standard test WSP 80.10 (09) A, the quantity (in grams) of fluid is measured which flows back into an overlying dry filter paper when a soaked nonwoven fabric is loaded with a 4 kg weight.

Runoff Test

Based on the WSP method 80.9, a PP spunbond nonwoven fabric is placed on a filter paper serving as an absorption layer, at an inclination of 45 degrees. The run length is determined that is necessary until a defined quantity of a synthetic urine solution was completely passed through the nonwoven fabric into the underlying absorption layer. Any test fluid that is not absorbed is collected in a drip pan, and the quantity is determined by weighing. The quantity of artificial urine solution that is not absorbed is to amount to a maximum of 5%.

The results of the examinations carried out for the composition according to Example 1 are given in Table 1 below, with the target values being contrasted with the respectively obtained measured values. The test is deemed to be passed if all measured values are within the range of the target values.

As comparative examples, the surfactant mixture without the hydrophobic additive and pure isopropyl palmitate were examined.

Example 1 according to the invention meets the requirements with respect to a rapid and permanent hydrophilizing of the polyolefin nonwoven fabric. In comparison with the pure surfactant mixture without an additive, no significant deterioration of the nonwoven properties occurs.

As expected, pure isopropyl palmitate exhibited no hydrophilizing properties.

To assess the touch or feel, a PP spunbond nonwoven fabric (15 g/m$^2$ weight per unit area) was treated with a 5% emulsion of the composition according to Example 1. The applied weight of active substance was 1%. For comparison, a PP spunbond nonwoven fabric was finished with the pure surfactant mixture, without a hydrophobic additive; the applied weight of active substance was adjusted to 0.5%. The test of the touch was performed by a panel test with at least 3 test persons who assess the touch.

The nonwoven fabric finished with the composition according to the invention had a pleasantly soft touch and, compared with the product finished with the pure surfactant mixture without a hydrophobic additive, had an improved feel.

TABLE 1

Test results for Example 1 and the Comparative Examples

| Examples | OPU [%] | Multiple strike through [s] | Single strike through [s] | Wetback [g] | Runoff [%] |
|---|---|---|---|---|---|
| Target | — | <2/<3/<5/<5/<5 | <3 | <0.6 | <5 |
| Example 1 | 1.75 | 1.34/2.18/2.28/2.19/2.4 | 2.57 | 0.57 | 3.1 |
| Pure surfactant mixture | 0.93 | 1.38/2.24/2.49/2.55/2.9 | 2.6 | 0.17 | 2.8 |
| Isoproapytel palmit | 1.53 | 15.92/14.13/16.4/ 13.88/26.97 | 42.1 | 0.1 | 99.2 |

Example 2

In a further experiment, the suitability of further hydrophobic additives for incorporation into various surfactant mixtures was examined. In addition, the proportion (% by weight) of the hydrophobic additive was determined up to which stable preparations and/or aqueous dilutions of the preparations can be obtained without a demixing of the components.

The results given in Table 2 below were obtained.

TABLE 2

| Hydrophobic additive | surfactant mixture 1 | surfactant mixture 2 | surfactant mixture 3 |
|---|---|---|---|
| Isopropyl palmitate | up to 50% | up to 40% | up to 40% |
| Decyl cocoate | min. 50% | min. 20% | min. 50% |
| Sesame oil | up to 30% | up to 30% | min. 50% |
| Soybean oil | up to 40% | up to 30% | min. 50% |

Surfactant mixture 1 is the mixture of non-ionic surfactants and an anionic surfactant in a weight ratio of about 90:10, as described in Example 1. Surfactant mixture 2 is a mixture of about 40 parts of a non-ionic surfactant and 60 parts of a cationic surfactant. For surfactant mixture 3, a mixture of non-ionic surfactants on the basis of ethoxylated triglycerides and fatty acid ethoxylate with an anionic surfactant in a weight ratio of about 98:2 was employed.

The results represented in Table 2 show that conventional fiber preparations are compatible with hydrophobic additives in a wide range. These compositions can be used in accordance with the invention as agents for applying a permanent hydrophilic finish to textile fibers and textile products such as nonwovens which can more particularly be further processed into sanitary products having an increased wearing comfort.

We claim:

1. A method of manufacturing permanently hydrophilically finished textile fibers and/or textile product, wherein the textile fibers and/or the textile product is treated with a surfactant composition containing at least one non-ionic surfactant and optionally at least one anionic and/or one cationic surfactant, the non-ionic surfactant being present in a proportion of from 10 to 90% by weight, based on the total weight of the composition and selected from the group consisting of alkoxylated $C_6$ to $C_{18}$ fatty alcohols, alkoxylated $C_6$ to $C_{18}$ amines, alkoxylated $C_6$ to $C_{18}$ amides, alkoxylated $C_6$ to $C_{18}$ fatty acids, alkoxylated $C_6$ to $C_{18}$ fatty acid esters, alkoxylated $C_8$ to $C_{18}$ alkyl phenols, alkoxylated triglycerides of $C_6$ to $C_{18}$ fatty acids, and esterification products thereof with $C_8$ to $C_{18}$ fatty acids and mixtures thereof, characterized in that the composition further contains a hydrophobic additive in a proportion of up to 60% by weight, based on the total weight of the composition, the hydrophobic additive comprising at least one compound of the group consisting of $C_8$ to $C_{24}$ fatty acid alkyl esters, vegetable oils and fats.

2. The method according to claim 1, characterized in that the hydrophobic additive is present in a proportion of from 5 to 60% by weight.

3. The method according to claim 1, characterized in that the composition additionally contains from 0.5% by weight to 5% by weight, based on the total weight of the composition, of care additives selected from the group consisting of vitamins, provitamins and vitamin precursors, humectants, aloe vera, and plant extracts.

4. The method according to claim 3, characterized in that the hydrophobic additive is present in a proportion of from 5 to 60% by weight.

5. The method according to claim 1, characterized in that the composition contains at least one anionic surfactant in a proportion of from 1 to 60% by weight, based on the total weight of the composition.

6. The method according to claim 1, characterized in that the composition contains at least one cationic surfactant in a proportion of from 1 to 60% by weight, based on the total weight of the composition.

7. The method according to claim 1, characterized in that the composition consists of:

35 to 80% by weight of a non-ionic surfactant, selected from the group of alkoxylated fatty acids and fatty alcohols with 6 to 18 C atoms in the hydrocarbon chain, alkoxylated triglycerides of $C_6$ to $C_{18}$ fatty acids, and mixtures thereof;

1 to 25% by weight of an anionic surfactant, the weight ratio of the non-ionic surfactant to the anionic surfactant being from 70:30 to 98:2;

20 to 50% by weight of the hydrophobic additive, selected from the group of $C_8$ to $C_{24}$ fatty acid alkyl esters, vegetable oils and fats, and mixtures thereof; and 0 to 5% by weight of a care additive selected from the group of vitamins, provitamins and vitamin precursors, humectants, aloe vera, and plant extracts.

8. The method according to claim 1, characterized in that the composition consists of:

15 to 65% by weight of a non-ionic surfactant, selected from the group of alkoxylated fatty acids and fatty alcohols with 6 to 18 C atoms in the hydrocarbon chain, alkoxylated triglycerides of $C_6$ to $C_{18}$ fatty acids, and mixtures thereof;

10 to 55% by weight of a cationic surfactant, the weight ratio of the non-ionic surfactant to the cationic surfactant being from 35:65 to 82:20;

20 to 50% by weight of the hydrophobic additive, selected from the group of $C_8$ to $C_{24}$ fatty acid alkyl esters, vegetable oils and fats, and mixtures thereof; and 0 to 5% by weight of a care additive selected from the group of vitamins, provitamins and vitamin precursors, humectants, aloe vera, and plant extracts.

9. The method according to claim 1, characterized in that the textile fibers are selected from the group of polyolefin fibers and polyester fibers.

10. The method according to claim 1, characterized in that the textile product is a nonwoven textile product manufactured from polyolefin fibers and/or polyester fibers.

11. The method according to claim 10, characterized in that the nonwoven textile product forms the body-side top layer of an absorbent article.

12. The method according to claim 10, characterized in that the nonwoven textile product is a polyolefin random laid nonwoven.

13. The method according to claim 10, characterized in that the nonwoven textile product is a needled polyolefin nonwoven.

14. The method according to claim 11, characterized in that the nonwoven textile product is a polyolefin random laid nonwoven.

15. The method according to claim 11, characterized in that the nonwoven textile product is a needled polyolefin nonwoven.

16. A permanently hydrophilically finished textile fiber, obtained by a process wherein a textile fiber is treated with a surfactant composition containing at least one non-ionic surfactant and optionally at least one anionic and/or one cationic surfactant, the non-ionic surfactant being present in a proportion of from 10 to 90% by weight, based on the total weight of the composition and selected from the group consisting of alkoxylated $C_6$ to $C_{18}$ fatty alcohols, alkoxylated $C_6$ to $C_{18}$ amines, alkoxylated $C_6$ to $C_{18}$ amides, alkoxylated $C_6$ to $C_{18}$ fatty acids, alkoxylated $C_6$ to $C_{18}$ fatty acid esters, alkoxylated $C_8$ to $C_{18}$ alkyl phenols, alkoxylated triglycerides of $C_6$ to $C_{18}$ fatty acids, and esterification products thereof with $C_8$ to $C_{18}$ fatty acids and mixtures thereof, characterized in that the composition further contains a hydrophobic additive in a proportion of up to 60% by weight, based on the total weight of the composition, the hydrophobic additive comprising at least one compound of the group consisting of $C_8$ to $C_{24}$ fatty acid alkyl esters, vegetable oils and fats.

17. A permanently hydrophilically finished textile product, obtained by a process wherein a textile product is treated with a surfactant composition containing at least one non-ionic surfactant and optionally at least one anionic and/or one cationic surfactant, the non-ionic surfactant being present in a proportion of from 10 to 90% by weight, based on the total weight of the composition and selected from the group consisting of alkoxylated $C_6$ to $C_{18}$ fatty alcohols, alkoxylated $C_6$ to $C_{18}$ amines, alkoxylated $C_6$ to $C_{18}$ amides, alkoxylated $C_6$ to $C_{18}$ fatty acids, alkoxylated $C_6$ to $C_{18}$ fatty acid esters, alkoxylated $C_8$ to $C_{18}$ alkyl phenols, alkoxylated triglycerides of $C_6$ to $C_{18}$ fatty acids, and esterification products thereof with $C_8$ to $C_{18}$ fatty acids and mixtures thereof, characterized in that the composition further contains a hydrophobic additive in a proportion of up to 60% by weight, based on the total weight of the composition, the hydrophobic additive comprising at least one compound of the group consisting of $C_8$ to $C_{24}$ fatty acid alkyl esters, vegetable oils and fats.

18. The permanently hydrophilically finished textile product according to claim 17 wherein the permanently finished textile product is a non-woven textile product.

19. A method of manufacturing permanently hydrophilically finished textile fibers and/or textile product, wherein the textile fibers and/or the textile product is treated with a surfactant composition, wherein the surfactant composition comprises, based on the total weight of the composition:

at least one non-ionic surfactant in a proportion of from 10 to 90% by weight;

at least one anionic surfactant in a proportion of from 1 to 60% by weight;

a hydrophobic additive in a proportion of 5 to 60% by weight; and at least one care additive in a proportion of 0.5% by weight to 5% by weight, wherein the non-ionic surfactant is selected from the group consisting of alkoxylated $C_6$ to $C_{18}$ fatty alcohols, alkoxylated $C_6$ to $C_{18}$ amines, alkoxylated $C_6$ to $C_{18}$ amides, alkoxylated $C_6$ to $C_{18}$ fatty acids, alkoxylated $C_6$ to $C_{18}$ fatty acid esters, alkoxylated $C_8$ to $C_{18}$ alkyl phenols, alkoxylated triglycerides of $C_6$ to $C_{18}$ fatty acids, and esterification products thereof with $C_8$ to $C_{18}$ fatty acids and mixtures thereof, and the hydrophobic additive is selected from the group consisting of $C_8$ to $C_{24}$ fatty acid alkyl esters, vegetable oils and fats, and wherein the care additive is selected from the group consisting of vitamins, provitamins humectants, aloe vera and plant extracts.

* * * * *